US011297440B2

(12) United States Patent
Bovin et al.

(10) Patent No.: US 11,297,440 B2
(45) Date of Patent: Apr. 5, 2022

(54) LOW PROFILE SURFACE MOUNT MICROPHONE

(71) Applicant: G.R.A.S. Sound & Vibration A/S, Holte (DK)

(72) Inventors: Jonas Kabell Bovin, Virum (DK); Kresten Marbjerg, Charlottenlund (DK)

(73) Assignee: G.R.A.S. SOUND AND VIBRATION A/S, Holte (DK)

( * ) Notice: Subject to any disclaimer, the term of this patent is extended or adjusted under 35 U.S.C. 154(b) by 0 days.

(21) Appl. No.: 16/492,052

(22) PCT Filed: Feb. 26, 2018

(86) PCT No.: PCT/EP2018/054616
§ 371 (c)(1),
(2) Date: Sep. 6, 2019

(87) PCT Pub. No.: WO2018/162263
PCT Pub. Date: Sep. 13, 2018

(65) Prior Publication Data

US 2021/0144484 A1 May 13, 2021

(30) Foreign Application Priority Data

Mar. 7, 2017 (EP) ..... 17159485

(51) Int. Cl.
*H04R 19/04* (2006.01)
*H04R 1/04* (2006.01)
*H04R 7/06* (2006.01)

(52) U.S. Cl.
CPC ..... *H04R 19/04* (2013.01); *H04R 1/04* (2013.01); *H04R 7/06* (2013.01)

(58) Field of Classification Search
CPC ..... H04R 19/04; H04R 19/005
USPC ..... 381/174–175
See application file for complete search history.

(56) References Cited

U.S. PATENT DOCUMENTS

| | | | | |
|---|---|---|---|---|
| 7,949,142 | B2 * | 5/2011 | Song | H04R 19/04 381/174 |
| 2005/0152571 | A1 * | 7/2005 | Chang | H04R 31/00 381/355 |
| 2007/0057602 | A1 * | 3/2007 | Song | H04R 31/006 310/328 |
| 2013/0094676 | A1 | 4/2013 | Muraoka et al. | |

FOREIGN PATENT DOCUMENTS

| | | | |
|---|---|---|---|
| WO | 2004/080122 | A1 | 9/2004 |
| WO | 2007/024047 | A1 | 3/2007 |

* cited by examiner

*Primary Examiner* — Suhan Ni
(74) *Attorney, Agent, or Firm* — Workman Nydegger

(57) ABSTRACT

A surface mountable condenser microphone (1) comprising a diaphragm (7) spaced by a spacer from a conductive capacitor layer (14), which is arranged on a surface of a back plate (15), wherein the back plate (15) is realized by a ceramic plate that carries the conductive capacitor layer (14) and isolated on another surface area of the same side of the back plate (15) a spacer layer (23) that projects over the conductive capacitor layer (14) and forms the spacer.

8 Claims, 2 Drawing Sheets

LOW PROFILE SURFACE MOUNT MICROPHONE

FIELD OF THE INVENTION

The invention relates to a surface mountable condenser microphone comprising a diaphragm spaced by a spacer from a conductive capacitor layer, which is arranged on a surface of a back plate.

BACKGROUND OF THE INVENTION

Document EP 1 649 718 B1 discloses a surface mountable condenser microphone to mount it on a printed circuit board of e.g. a mobile phone. The condenser microphone disclosed is an electret condenser microphone that comprises a cylindrical shaped housing which holds a diaphragm and a back plate spaced by a spacer and a processing circuit arranged under the back plate. The mechanical elements of this surface mountable condenser microphone are built and arranged in a way that the housing of the microphone projects substantially over the surface it is mounted on. This is acceptable for use cases in a mobile phone, but would be too high and bulky for other use cases. Such other use cases are for instance surface mountable microphones used to glue them on airplane surfaces for in-flight testing or to glue them on the blade of a wind turbine. Document US 2011/192212 A1 discloses such a use case where microphones on blades of a wind turbine are used as sensors to analyze animal impacts on the blade. Surface mountable microphones for such use cases have to be as thin and robust as possible.

Documents US 2013/0094676 A1 and WO 2004/080122 A1 disclose surface mountable condenser microphones with a substantial number of parts to be assembled what increases the thickness and complexity of these microphones.

SUMMARY OF THE INVENTION

It is an object of the invention to provide a surface mountable microphone with a thin housing, that projects only as less as possible over the surface it is mounted on. This object is achieved with a microphone with a back plate that is realized by an isolating carrier and that the back plate carries the conductive capacitor layer and that the back plate furthermore carries isolated from the conductive capacitor layer on another surface area of the same side of the back plate a spacer layer that projects over the conductive capacitor layer and forms the spacer.

This mechanical set-up results in a surface mountable condenser microphone with a back plate made of e.g. a ceramic plate that carries on one side of the back plate two layers wherein one of the layers, the spacer layer is a conductive or non-conductive layer and is thicker than the other layer, the conductive capacitor layer. In one preferred embodiment the spacer layer is realized by a conductive layer of metal that projects for instance 0.02 mm over the conductive capacitor layer of the back plate what results in an air gap of the diaphragm of 0.02 mm. In other embodiments a smaller air gap like 0.01 mm or an even smaller air gap could be realized while still in other embodiments a larger air gap like 0.1 mm or even more could be realized. This realization of a spacer by different thick conductive layers on a ceramic back plate enables a flat and robust realization of a surface mountable condenser microphone. The isolating back plate may be realized with any kind of isolating material used in the circuit board technology like laminates of cloth of fiber material or paper with thermoset resin to form an integral final piece of uniform thickness.

It is furthermore advantageous to span the diaphragm with a fixation element like one or two fixation rings over the spacer layer to fix the diaphragm to the back plate. A holding element like a holding ring arranged between the fixation ring and the back plate can be used to arrange the back plate in a defined distance from a basis ceramic plate to form a back volume of the condenser microphone. These mechanical arrangements support to achieve a flat and robust condenser microphone.

It is particular advantageous to arrange a venting channel from the back volume to the area outside of the housing of the condenser microphone to ensure that the average static pressure on both sides of the diaphragm is equal. This venting channel must be narrow to avoid that sound waves travel through and affect the sound captured with the microphone. In a preferred embodiment such venting channel comprises a spiral groove formed between the fixation element and the holing element, which venting channel is completed when the microphone is assembled.

These and other aspects of the invention will be apparent from and elucidated with reference to the embodiments described hereinafter. The person skilled in the art will understand that various embodiments may be combined.

DETAILED DESCRIPTION OF EMBODIMENTS

Figure 1:
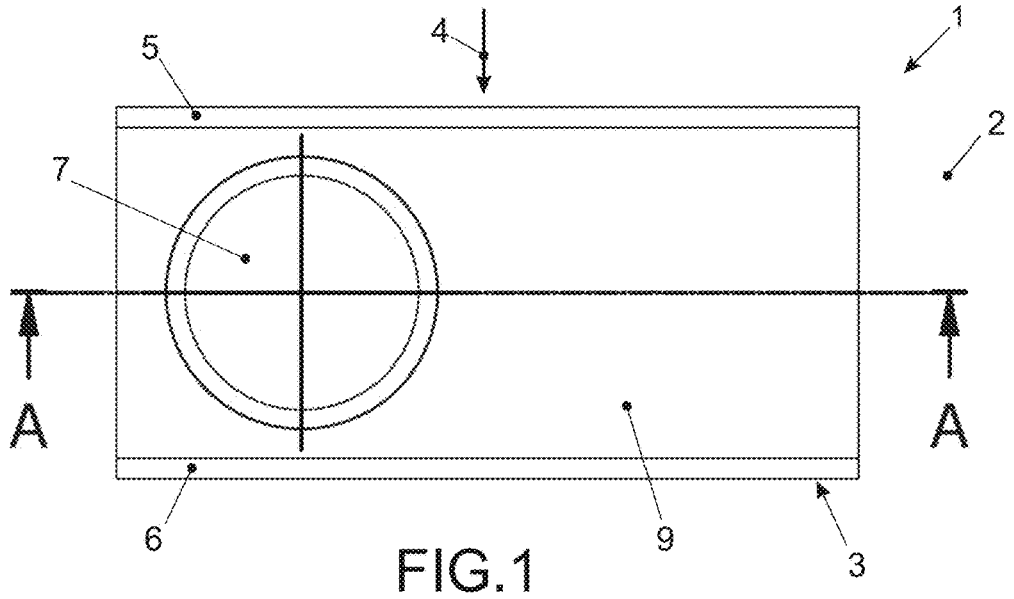
FIG. 1 shows a top view on a surface mounted condenser microphone according to an embodiment of the invention.

FIG. 1 shows surface mountable condenser microphone 1 that is glued on the surface 2 of a wing of an airplane. Microphone 1 is used to measure noise caused by air turbulences along the wing to improve the form of the wing of the airplane and to learn more about the actual airflow along the surface of the wing. Microphone 1 may be glued as well on the surface of a wind turbine or other surfaces to measure relevant physical parameters. To avoid that microphone 1 itself causes air turbulences that influence the measurement of the physical parameters, the housing of microphone 1 has to be flat and windswept. This is achieved by a mechanical and electrical set-up as will be explained below.

Figure 2:
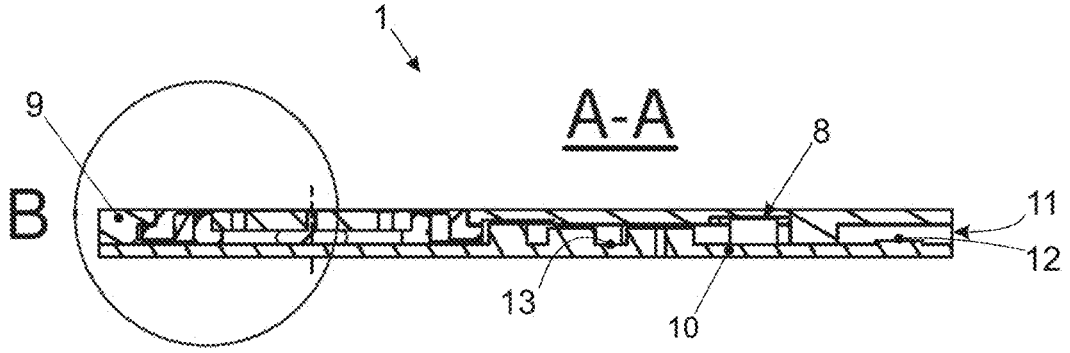
FIG. 2 shows a cross sectional side view A-A of the condenser microphone according to FIG. 1.

Microphone 1 comprises a housing 3 and is glued on surface 2 in a way that the main wind direction 4 is substantially vertical to ramp areas 5 and 6 of housing 3 to reduce air turbulences. Microphone 1 furthermore comprises a circular diaphragm 7 that covers about one half of the surface area of the housing 3. Beneath the other half of the surface area of housing 3 a processing circuit 8 to process the electrical signal provided by the condenser element of the microphone 1 is arranged as can be seen in FIG. 2. This side-by-side arrangement of the mechanical parts of the condenser microphone 1 and the processing circuit 8 advantageously supports the flat set-up of microphone 1.

Housing 3 of microphone 1 is built of a cap 9 that together with a basis ceramic plate 10 encloses all elements of microphone 1 with only one opening 11 for output contacts 12 of microphone 1 arranged on a conductive surface layer 13 of the basis ceramic plate 10. This enables to realize microphone 1 particular robust and reliable. Conductive surface layer 13 provides the electrical contact between electrical elements of processing circuit 8 and the output contacts 12 and a conductive capacitor layer 14 of the condenser microphone 1.

Figure 3:
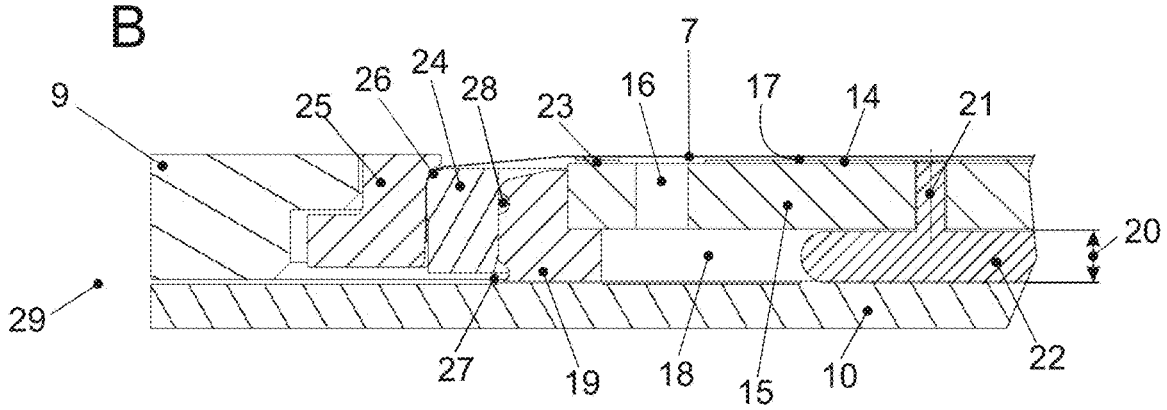
FIG. 3 shows a detail B of the cross sectional side view A-A according to FIG. 2.
Figure 4:
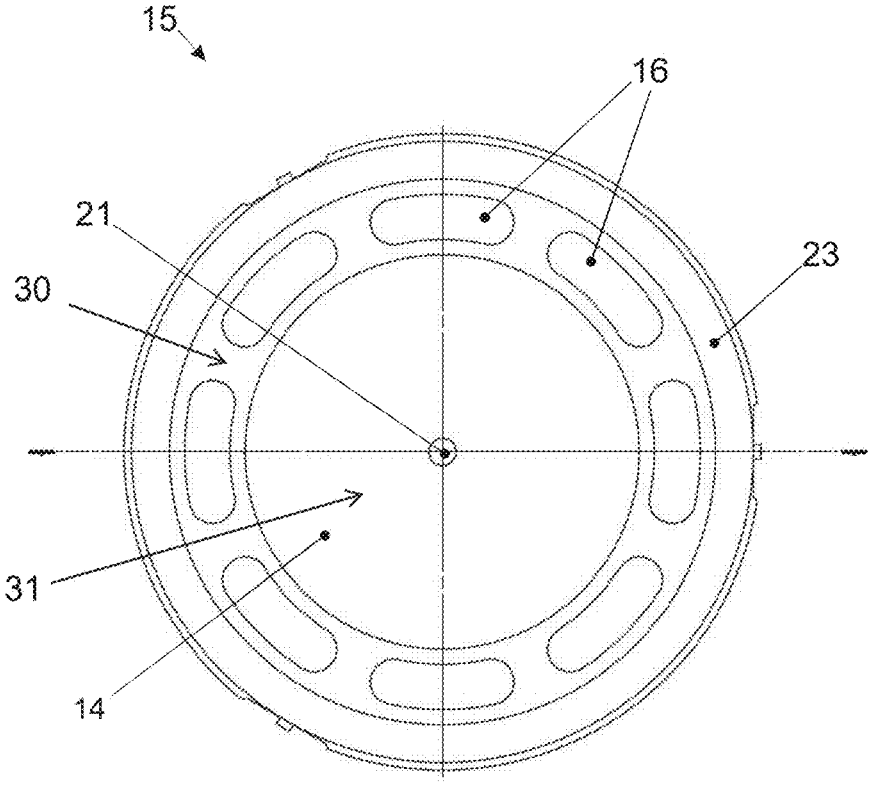
FIG. 4 shows a top view of the back plate of the condenser microphone according to FIG. 1.
Figure 5:
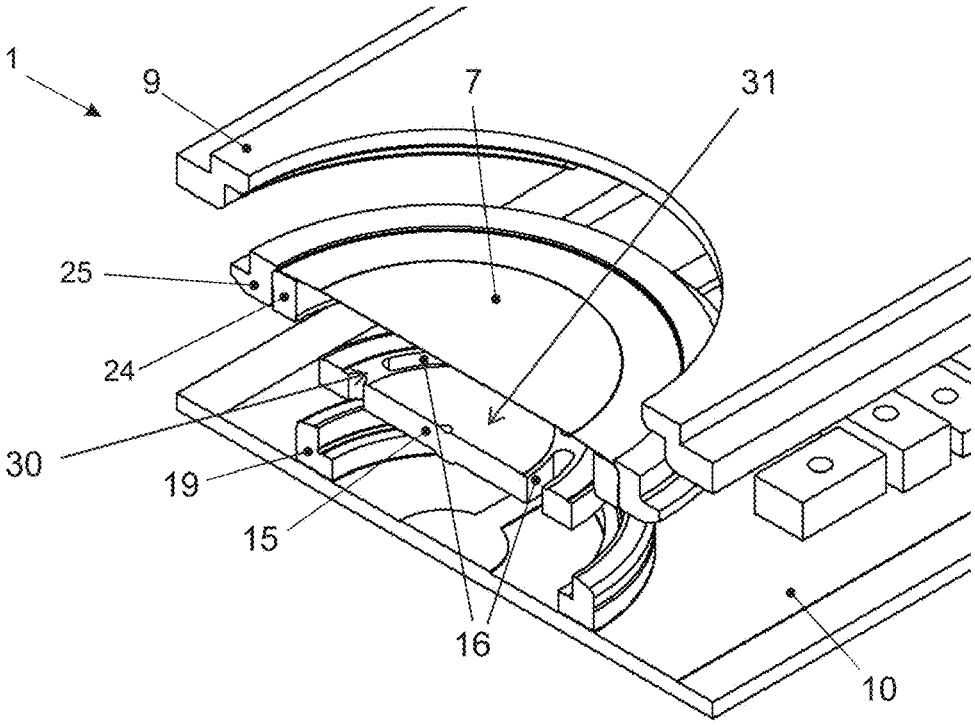
FIG. 5 shows a diagonal view of the condenser microphone according to FIG. 1.

FIG. 3 shows a sectional view and FIG. 5 shows a diagonal view of the mechanical elements most relevant for the acoustic performance of the microphone 1. A circular back plate 15, shown in a top view in FIG. 4, is realized with ceramic material as a ceramic plate. Back plate 15 comprises several holes 16 arranged on a diameter to enable air flow from an air gap 17 between the diaphragm 7 and the back plate 15 to a back volume 18 realized between the back plate 15 and the basis ceramic plate 10. The holes 16 are separated by an isolation area 30. A housing element realized as holding ring 19 holds the circular back plate 15 in a distance 20 to build sidewalls of back volume 18.

Back plate 15 furthermore comprises a contact hole 21 in the center that is filled with a conductive glue 22 that provides electrical contact between the conductive capacitor layer 14, disposed on a center area 31 of the back plate 15, and the processing circuit 8 on conductive surface layer 13. In use acoustic airwaves move diaphragm 7 what reduces and increases air gap 17 that builds a dielectricum for the capacitor with the conductive capacitor layer 14 as one of the capacitor plates. As a result, an electrical signal influenced by the particular acoustic airwaves is detected and processed by processing circuit 8.

Microphone 1 comprises a spacer that spaces diaphragm 7 from the conductive capacitor layer 14 to define and fix the distance of the air gap 17. This spacer is realized by a second conductive layer, named conductive spacer layer 23, on the same surface of back plate 15, but a different surface area of back plate 15. The conductive capacitor layer 14 is isolated from the conductive spacer area 23 in the area of holes 16. The air gap 17 is realized in that way that the conductive spacer area 23 is thicker than the conductive capacitor layer 14. Therefore, there is a well defined difference in layer thickness of the conductive capacitor layer 14 and the conductive spacer layer 23 which difference of the thickness of the layers provides a defined air gap 17. As such conductive layers on ceramic plates may be manufactured by known manufacturing technologies like etching in a cheap and precise way, it is easy and robust to manufacture microphone 1 with a defined air gap 17.

Microphone 1 furthermore comprises a fixation element formed by a first fixation ring 24 and a second fixation ring 25. The first fixation ring 24 is arranged between holding ring 19 and the second fixation ring 25 and comprises a circular area 26 to smoothly hold diaphragm 7 between the first fixation ring 24 and the second fixation ring 25 to span it over the conductive spacer layer 23. In the assembled microphone 1 the circular area 26 therefore is arranged slightly below the level of the conductive spacer layer 23.

Holding ring 19 as part of the housing elements of microphone 1 comprises a venting channel 27 with part of it formed as spiral grove 28 to enable air ventilation from back volume 18 to an area 29 outside of the housing of microphone 1. Venting channel 27 must be narrow and long to avoid that sound waves travel through it and affect the sound captured 10 with microphone 1. It is in particular advantageous to form part or all of the venting channel 27 as spiral grove 28 as this extends the lengths of the venting channel 27 and enables easy production in a way a screw is manufactured. In another example of the invention part or all of the spiral groove 28 could be realized in the first fixation ring 24 with a flat surface of holding ring 19. Other forms similar to a spiral grove with the same technical 15 effect to extend the length of a narrow venting channel 27 could be used as well.

With all these advantageous mechanical and electrical arrangements microphone 1 may be realized with a thickness of only 1 mm or even smaller like 0.9 mm or 0.8 mm. This small realization of the surface mountable condenser microphone 1 enables minor or even no turbulences caused by the microphone 1 what enables to achieve a higher accuracy of the 20 physical parameters like sound or pressure measured by microphone 1.

In other examples of the invention the spacer could be realized by two conductive layers above each other. Above a first conductive surface layer in the area of the spacer a second conductive surface could be added on top of this first surface layer to achieve projection and the air gap of the diaphragm.

In another example of the invention only one fixation ring to fix the diaphragm between the fixation ring and the holding ring could be realized. In another example with two fixation rings the first fixation ring could be used to hold the back plate and build sidewalls of the back volume.

In another example the back plate and the basis plate could be realized by 30 another material similar to ceramic like print card material like flex print that enables to 22805-WO generate conductive layers on the surface. In principle the back plate could be realized by any isolating material with sufficient stiffness.

In another example the spacer layer is realized by a non-conductive material like glass or soldering mask to build the spacer layer. Any kind of material or manufacturing process would be fine that enables to generate a very thin layer of material to 5 space the conductive capacitor layer from the membrane. In a further example the spacer layer is realized by an elevation of the back plate as part of the back plate. This has the advantage that no separate layer needs to be added to the back plate to realize the spacer layer.

The invention claimed is:

1. A surface mountable condenser microphone comprising:

a diaphragm spaced by a spacer from a conductive capacitor layer, said conductive capacitor layer arranged on a surface of a back plate, wherein the back plate is realized by an isolating carrier, wherein the back plate carries the conductive capacitor layer, wherein the back plate furthermore carries, isolated from the conductive capacitor layer on another surface area of a same side of the back plate, a spacer layer that projects over the conductive capacitor layer and forms the spacer, and wherein the conductive capacitor layer is arranged on a center area of the back plate surrounded by a ring-formed spacer layer having a difference in layer thickness, the conductive capacitor layer and the ring-formed spacer layer being isolated by an isolation area of the back plate in between.

2. The condenser microphone according to claim 1, wherein the diaphragm is spanned by a fixation element over the spacer layer to form an air gap between the diaphragm and the conductive capacitor layer.

3. The condenser microphone according to claim 2, wherein the back plate comprises air ventilation holes in the isolation area and wherein a housing element is built to hold the back plate in a distance from a basis ceramic plate to form a substantially closed back volume of the condenser microphone.

4. The condenser microphone according to claim 3, wherein the housing element comprises a venting channel to enable air ventilation from the back volume to an area outside of a housing of the condenser microphone.

5. The condenser microphone according to claim 4, wherein the venting channel includes a spiral groove formed between the housing element and the fixation element.

6. The condenser microphone according to claim 4, wherein the housing of the condenser microphone comprises a cap that together with the basis ceramic plate encloses all elements of the condenser microphone with only one opening for output contacts of the condenser microphone arranged on the conductive surface layer.

7. The condenser microphone according to claim 3, wherein the conductive capacitor layer is contacted through a hole of the back plate and a conductive element in the back volume with a conductive surface layer of the basis ceramic plate that contacts the conductive capacitor layer with a processing circuitry arranged on the conductive surface layer outside of the fixation element.

8. The condenser microphone according to claim 1, wherein the isolating carrier of the back plate is realized by a ceramic plate.

* * * * *